US005718088A

United States Patent [19]

Jacobsen

[11] Patent Number: 5,718,088

[45] Date of Patent: Feb. 17, 1998

[54] ROOF STRUCTURE COMPRISING A ROOF PENETRATING INSTALLATION, AN EXTERNAL ROOF COVERING, AN UNDERROOF AND A FITTING COLLAR FOR SEALINGLY JOINING SAID INSTALLATION WITH SAID UNDERROOF AND A METHOD FOR THE MANUFACTURE OF SAID FITTING COLLAR

[75] Inventor: Per Jacobsen, Horsens, Denmark

[73] Assignee: V. Kann Rasmussen Industri A/S, Søborg, Denmark

[21] Appl. No.: 382,038

[22] PCT Filed: Sep. 9, 1993

[86] PCT No.: PCT/DK93/00289

§ 371 Date: Feb. 10, 1995

§ 102(e) Date: Feb. 10, 1995

[87] PCT Pub. No.: WO94/08108

PCT Pub. Date: Apr. 14, 1994

[30] Foreign Application Priority Data

Oct. 7, 1992 [DK] Denmark ..... 1232/92

[51] Int. Cl.[6] ..... E04D 3/38

[52] U.S. Cl. ..... 52/200; 52/58

[58] Field of Search ..... 52/200, 58, 72, 52/219, 60

[56] References Cited

U.S. PATENT DOCUMENTS

| | | | |
|---|---|---|---|
| 3,247,632 | 4/1966 | Bloxsom | 52/58 |
| 3,304,667 | 2/1967 | Donegan | 52/60 |
| 3,363,369 | 1/1968 | Miller | 52/60 |
| 3,577,691 | 5/1971 | Kallin | 52/72 |
| 3,802,131 | 4/1974 | Resech | 52/60 |
| 3,838,544 | 10/1974 | Hindall | 52/60 |
| 4,428,166 | 1/1984 | Burghart | 52/72 X |
| 4,603,517 | 8/1986 | Lyons | 52/60 |
| 4,635,409 | 1/1987 | Vandemore | 52/60 |
| 4,781,008 | 11/1988 | Lyons | 52/60 X |
| 4,825,608 | 5/1989 | Makin | 52/200 |
| 4,930,274 | 6/1990 | Cummings et al. | 52/200 |
| 4,937,991 | 7/1990 | Orth | 52/60 X |
| 4,951,431 | 8/1990 | Sweers | 52/60 X |
| 4,986,039 | 1/1991 | Weisner | 52/200 X |
| 5,016,406 | 5/1991 | Calam | 52/58 |
| 5,018,333 | 5/1991 | Bruhm | 52/60 X |
| 5,062,247 | 11/1991 | Dittmer | 52/200 |
| 5,072,552 | 12/1991 | Sauder | 52/58 |
| 5,077,943 | 1/1992 | McGaoy | 52/58 |
| 5,094,040 | 3/1992 | Bunka | 52/200 X |

*Primary Examiner*—Wynn E. Wood
*Assistant Examiner*—Beth Aubrey
*Attorney, Agent, or Firm*—Lane, Aitken & McCann

[57] ABSTRACT

For sealingly joining an underroof to a skylight or another roof installation a fitting collar is provided comprising a film element (7, 8) with a substantially U-shaped plane configuration with a cutout, at the sides of which there are flange parts (9, 10) for attachment of the fitting collar to mutually adjoined exterior sides (1–4) of the main frame structure of the window or the roof installation, in such manner that the film element is brought to extend substantially in parallel with the roof surface, in order to connect with adjacent parts (5, 6) of the underroof. The fitting collar can be manufactured in a simple manner, in that there in two overlapping lengths of film is produced transversal welds, at distances corresponding to a prescribed main frame width, whereby an obliquely extending part of each weld is formed with two parallel welded seams, while there in the edge zones at the opposite side edges of the lengths of film in extension of one and the other, respectively, of the two parallel welded seams are produced welded seams, which are perpendicular to the side edges. The collar elements are then separated by cutting along the cutting lines (22) between the parallel welded seams and parallel to the welded seams perpendicular to the side edges, and the collar is completed by cutting one length of film along the mid line between the welded seams with a subsequent bending upwards of the attachment flange parts.

7 Claims, 1 Drawing Sheet

Figure 1:
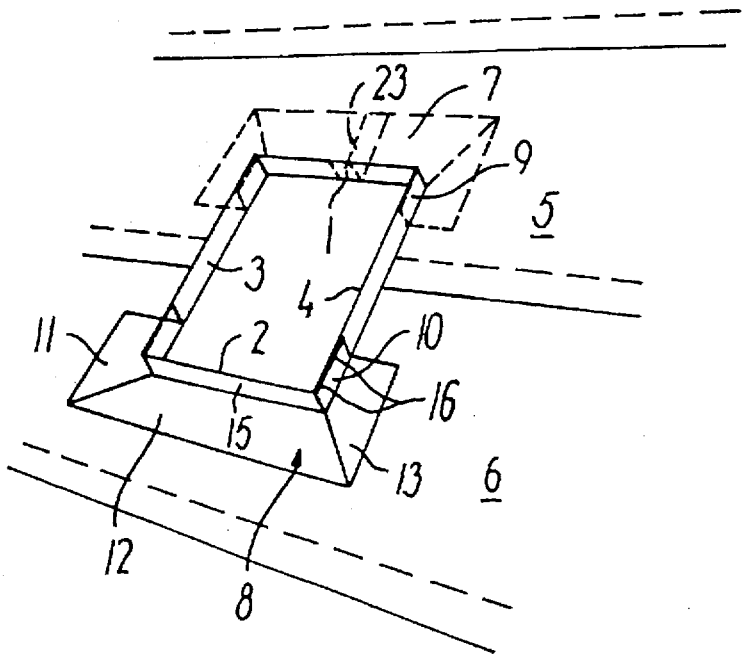

ROOF STRUCTURE COMPRISING A ROOF PENETRATING INSTALLATION, AN EXTERNAL ROOF COVERING, AN UNDERROOF AND A FITTING COLLAR FOR SEALINGLY JOINING SAID INSTALLATION WITH SAID UNDERROOF AND A METHOD FOR THE MANUFACTURE OF SAID FITTING COLLAR

The invention relates to a fitting collar for sealingly joining an underroof to a skylight or another roof installation, where said roof installation is to be installed in a roof by penetrating the roof surface with a cut, which is substantially rectangular in the plane of the penetration.

In order to prevent driving rain, drifting snow, or possibly condensed water from causing moisture damage, an underroof is commonly placed under inclined roofs made from roofing tiles, slating, or corrugated asbestos cement sheets, where said underroofing consists of a possibly reinforced plastic film, which is placed between the laths and rafters of the roof structure.

With conventional underroof products delivered as lengths of plastic film, considerable effort is required to achieve a sufficiently sealed joining of the film of the underroofing to roof installations that break through the roof surface, for instance the main frame structure of skylights, chimneys, or other roof installations. The installation thus becomes both time consuming and expensive.

In order to overcome this problem, the invention aims to provide a fitting collar, which is both inexpensive to manufacture and simple to install, while it at the same time assures an optimally tight joint to the underroof, regardless of whether it is a case of installing skylights or other roof installations in an existing roof or a in new building.

The fitting collar according to the invention is characterized in that it comprises a film element with a substantially U-shaped plane configuration with a cutout, at the sides of which flange parts are provided for attachment of the fitting collar to the mutually adjoining exterior sides of a main frame structure of said window or of said roof installation, in such a manner that the film element is brought to extend substantially in parallel with the roof plane, in order to connect to the adjacent parts of the underroof.

When installing a main frame structure of a skylight, where this conventionally takes place by mounting the mounting brackets fixed to the main frame structure on the rafter elements of the roof structure, the main frame structure is before or after the mounting provided with such U-shaped fitting collars, which are attached to the top member and bottom member, respectively, of the main frame structure, and to a part of the adjoining side members of the main frame. The fitting collar at the top may then without difficulty be inserted under the existing overlying length of underroofing, while the fitting collar at the bottom can be mounted on top of the existing underlying length of underroofing.

During installation on the main frame structure of a window, the fitting collars can be attached to the main frame members by bonding, taping or stapling.

In a preferred embodiment the film element of the fitting collar comprises three single layer film parts, which are welded together at oblique corner joints, and thus define the bottom and the sides of the U-shaped plane configuration, and of which the side parts are substantially perpendicular to the bottom part, whereby the flange parts for attachment are formed by the edge zones of the three elements, said edge zones facing the cutout.

With this design a particularly simple and inexpensive manufacture can be achieved in that it is manufactured by a transversal welding together of two overlapping lengths of film along welded seams, which in connection with a part perpendicular to one of the flush lengthwise sides of the lengths of film in a relatively narrow edge zone, extend obliquely at an angle with respect to the lengthwise direction of the lengths of film corresponding to the prescribed angle for the corner joints, and end at a short distance away from the opposite flush lengthwise sides, after which one of the two lengths of film is cut perpendicular to the lengthwise direction of the film lengths along the mid line between the two welded seams, in order to form the U-shaped plane configuration by folding the two parts of the cut length of film along the welded seams, with a subsequent making of the flange parts for attachment by folding the said edge zones upwards.

As a result of the very simple design, the fitting collars according to the invention can with a single standard size be adapted to differently dimensioned roof installations, for instance skylights with main frame structures of different sizes within a series of skylights.

Such a simplification and reduction in price of the production can be achieved by manufacturing the fitting collar with a length of the bottom part of the U-shaped plane configuration corresponding to the greatest occurring main frame width within the said series of skylights, in order to provide a fit to occurring lesser main frame widths by folding the bottom part of the fitting collar into a pleat.

The invention furthermore relates to a method for the manufacture of the fitting collar in the above preferred embodiment, where said method is suitable for industrial mass production. According to the invention, this method is characterized in that there in two overlapping lengths of film with flush side edges are provided said transversal welds separated by distances corresponding to a prescribed main frame width, where the obliquely extending part of each weld is provided with two parallel welded seams, while the welded seams perpendicular to the side edges are carried out at the edge zones at the opposite side edges in extension of one and the other, respectively, of the two parallel welded seams, after which the collar elements are separated by cutting along cutting lines between the parallel welded seams and in parallel to the welded seems perpendicular to the side edges.

Figure 2:
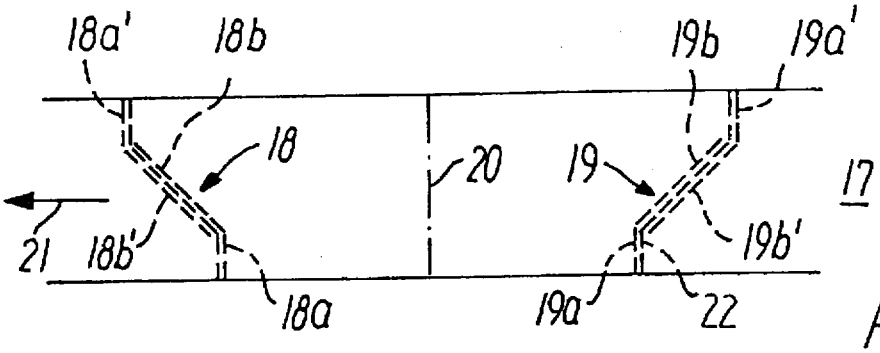
Figure 3:
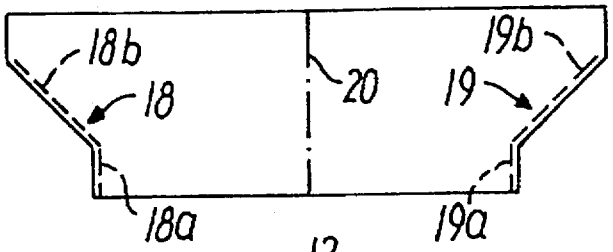
Figure 4:
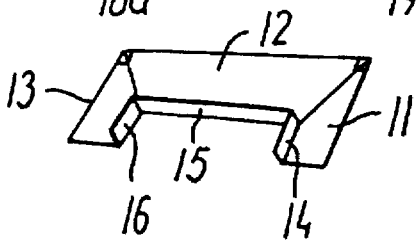

The invention will in the following be explained in more detail, with reference to the accompanying schematic drawing, where FIG. 1 shows a main frame structure of a skylight installed in an inclined roof and provided with fitting collars according to the invention, and FIGS. 2–4 illustrate the manufacture of a preferred embodiment of the fitting collar.

The main frame structure of a skylight shown in FIG. 1 comprises a top member 1 and a bottom member 2, in addition to side members 3 and 4, and is designed for installation in an inclined roof in a conventional manner by not shown mounting brackets, which are fastened to the side members 3 and 4 of the main frame structure, and then fixed to the likewise not shown rafter elements of the roof structure.

In order to allow for a sealing joint to an underroof comprising lengths of film 5 and 6, these being installed perpendicularly upon the rafter elements of the roof structure, two fitting collars 7 and 8 are attached to the main frame structure. Each of the fitting collars 7 and 8 generally comprises a substantially U-shaped film element, the edges of which at the cutout of the U-shape are designed with flange parts 9 and 10, whereby the fitting collar can be attached to the top member 1 of the main frame and the upper parts of the side members 3 and 4 adjoining thereto, and to the bottom member 2 of the main frame and the bottom parts of the side members 3 and 4 adjoining thereto, respectively.

The fitting collar can be made from the same type of film material as conventional underroofing products, for instance a polyethylene film reinforced with a network of fibre glass threads. During mounting onto the shown main frame structure, the flange parts 9 and 10 are attached by bonding, or by means of tape or by stapling.

During the installation the upper fitting collar 7 is inserted below the previously installed length of underroofing 5, wherein an opening for the main frame structure is provided, and is attached to the inside thereof, for instance by means of tape, while the bottom fitting collar 8 is attached to the top side of the underlying length of underroofing 6.

As shown for the bottom fitting collar 8, the collar in a preferred embodiment comprises three film elements 11, 12, and 13, which are welded together, and which define the bottom and the sides of the U-shaped collar, in that the side parts 11 and 13 are substantially perpendicular to the bottom part 12, while the flange part 10 is formed by the upwardly folded edge zones 14, 15, and 16 of the three film elements 11, 12, and 13.

Fitting collars according to the invention can be simply and inexpensively manufactured by the transversal welding together of two overlapping lengths of film 17, which have flush side edges, and in FIG. 2 are shown from above. For each of the fitting collars the two welded seams 18 and 19 comprise a relatively short edge part, **18*a* and 19*a*, respectively, these being perpendicular to one side edge of the lengths of film 17, and an obliquely extending part 18*b* and 19*b*, respectively, which is connected to the short edge part, and which defines an angle with the lengthwise axis of the lengths of film corresponding to the prescribed angle for the corner joints of the finished fitting collar, i.e. in practice 45 degrees. The obliquely extending parts, 18*a* and 19*a*, of the welded seams end at a distance from the opposite side edges of the lengths of film corresponding to the length of the welded seam parts 18*a* and 19*a***, such that there is no welding together of the lengths of film in an edge zone at this side edge.

During manufacture, the transversal welds 18 and 19 are produced continuously as the overlapping lengths of film 17 are conveyed, for instance in the direction indicated by the arrow 21 on FIG. 2, and at a separation distance between the welded seams corresponding to a prescribed width of the window frame structure.

In each of the welded seams 18 and 19 the obliquely extending part is provided with two parallel welded seams, **18*b*, 18*b*', and 19, 19*b*', respectively, while there at the two edge zones at the opposite side edges of the lengths of film are provided short welded seam parts 18*a*, 18*a*' and 19*a*, 19*a*'**, respectively, in extension of one and the other, respectively, of the two parallel welded seams.

After the welding, the individual fitting collars are separated from the lengths of film 17 by cutting along cutting lines 22, which extend in between the parallel welded seams, for instance **18*b*, 18*b*', of each weld and in parallel with the welded seams perpendicular to the side edges, for instance 18*a* and 18*a*', after which the element shown in FIG. 3 is obtained, from which element the fitting collar, as mentioned, is completed by cutting one of the lengths of film 17 along the dashed line 20**.

The U-shaped fitting collar can then be produced by cutting one of the lengths of film 17 along the dashed line 20, after which the two parts of the cut length are folded back along the welded seams 18 and 19, in order to provide the side parts 11 and 13 of the fitting collar.

By a subsequent upward folding of the edge zones determined by the welded seam parts **18*a* and 19*a*, the flange parts, 14, 15, and 16, for attachment of the complete fitting collar are produced, as shown in FIG. 4**.

The design of the fitting collar according to the invention results in the particular advantage that a single standard size, produced with dimensions corresponding to a maximum width of a main frame structure for a series of skylights with varying main frame sizes, can be adapted to smaller main frame widths by making a pleat 23, as shown in FIG. 1, in the bottom part 12 of the fitting collar.

As is apparent in the above and in the illustrations in FIGS. 2 and 3, the design furthermore results in the advantage that the manufacture takes place completely without wasting material, as fitting collars, after cutting along the lines 22, can be successively separated out from the overlapping lengths of film 17 with the described design of the welds 18 and 19, where the resulting fitting collars have alternating inverted orientations.

In order to achieve a certain possibility for ventilation around the main frame structure and thus avoid the risk of moisture damages therein as a consequence of the hermetically tight attachment of the fitting collars, the attachment flanges of said fitting collars can, in order to be stapled to the main frame structure at distinct points, at least be designed with embossed convex beads 24 in the shape of bubbles or the like at the sides intended for contact with the main frame structure. In connection with the manufacturing method described above, such an embossment can be made in the edge zone of the length of film 17, before these are laid on top of each other and joined by the described transversal welded seams, such that the convex beads 24 protrude from the top and bottom sides, respectively, of the overlapping lengths of film.

I claim:

1. A roof structure comprising an external roof covering, an underroof of a flexible relatively thin plastic film material placed under said roof covering and a roof penetrating installation such as a sky light window, having a substantially rectangular main frame, said roof penetrating installation penetrating said roof covering and said underroof, characterized in that a fitting collar (7, 8) sealingly joins said roof penetrating installation to said underroof, said collar being made entirely of a plastic film material of a flexibility matching that of the underroof material and being of a substantially U-shaped plane configuration with a cutout, the edges of the collar having attachment flange parts (9, 10) attached to mutually adjoining exterior sides (1–4) of said main frame, whereas remaining parts of the collar outside said flange parts extend substantially parallel to the roof structure for connection to adjacent parts (5, 6) of the underroof.

2. A roof structure as claimed in claim 1, characterized in that the fitting collar (7, 8) comprises three film segments (11, 13) which are welded together at oblique corner joints to form a bottom part and side parts of said U-shaped plane configuration, the side parts (11, 13) being substantially perpendicular to the bottom part (12), said attachment flange parts (14–16) being formed by edge zones of said film segments facing said cutout.

3. A roof structure as claimed in claim 2, characterized in that the attachment flange parts (14, 16) of at least said side parts (11, 13) are provided with embossed convex beads.

4. A fitting collar for use in a roof structure comprising an external roof covering, an underroof of a flexible relatively thin plastic film material placed under said roof covering and a roof penetrating installation, such as a sky light window, having a substantially rectangular main frame, characterized in that the fitting collar is made entirely of a plastic film material and is of a substantially U-shaped plane configuration with a cutout, the edges of which provide flange parts (9, 10) for attachment of the fitting collar to mutually adjoining exterior sides (1–4) of the main frame structure of a roof penetrating installation such as a sky light window, wherein the remaining parts of the collar outside said flange parts are adapted to extend substantially parallel to the roof structure for connection to adjacent parts (5, 6) of an underroof, said U-shaped configuration being composed of three film segments (11, 13) which are welded together at oblique corner joints to form a bottom part and side parts of said configuration, the side parts (11, 13) being substantially perpendicular to the bottom part (12), said attachment flange parts (14–16) being formed by edge zones of said film segments facing said cutout.

5. A fitting collar as claimed in claim 4, characterized in that the attachment flange parts (14, 16) of at least said side parts (11, 13) are provided with embossed convex beads.

6. A method for manufacturing a fitting collar made entirely of a plastic film material and having a substantially U-shaped plane configuration with a cutout, the edges of which provide flange parts (9, 10) for attachment of the fitting collar to mutually adjoining exterior sides (1–4) of the main frame structure of a roof penetrating installation such as a sky light window, wherein the remaining parts of the collar outside said flange parts are allowed to extend substantially parallel to the roof structure for connection to adjacent parts (5, 6) of an underroof, said U-shaped configuration being composed of three film segments (11, 13) which are welded together at oblique corner joints to form a bottom part and side parts of said configuration, the side parts (11, 13) being substantially perpendicular to the bottom part (12), said attachment flange parts (14–16) being formed by edge zones of said film segments facing said cutout, comprising:

overlapping two lengths of plastic film material, each having two side edges, with each other with said side edges of said plastic film material being flush with each other;

welding said lengths of plastic film material together in transversal weldings at a separation corresponding to a prescribed main frame width such that each of said weldings comprises two weld seams (18, 19) each having an outer part (**18*a*, 19*a*) extending perpendicular to one of said side edges, through an edge region defining said attachment flange part, and (b) an oblique part (18*b*, 19*b***) extending between said edge regions parallel to the oblique part of the other weld seam, said outer part of one of said weld seams of each said welding extending perpendicular to one of said side edges, and said outer part of the other of said weld seams of each said welding extending perpendicular to the other of said side edges;

separating fitting collars from said lengths of plastic film material by cutting the welded lengths of plastic film material along cutting lines (22) extending between said weld seams in said oblique parts;

forming said U-shaped plane configuration of said collar by cutting one of said lengths of plastic film material along a cutting line (20) perpendicular to said side edges substantially midway between said weldings;

and folding the parts of said cut one length along said oblique parts of the welding seams to form the side parts of said U-shaped configuration.

7. A method as claimed in claim 6, further comprising forming convex beads in the attachment flange parts of at least said side parts by embossing edge zones of said lengths of plastic film material before bringing the lengths together in mutual overlapping relationship.

* * * * *

UNITED STATES PATENT AND TRADEMARK OFFICE

CERTIFICATE OF CORRECTION

PATENT NO. : 5,718,088

DATED : February 17, 1988

INVENTOR(S) : Per Jacobsen

It is certified that error appears in the above-indentified patent and that said Letters Patent is hereby corrected as shown below:

Claim 6, column 6, line 11, "(a)" should be inserted after "having".

Signed and Sealed this

Twelfth Day of May, 1998

*Attest:*

*Attesting Officer*

BRUCE LEHMAN

*Commissioner of Patents and Trademarks*